US008607388B1

(12) United States Patent
Flanagan et al.

(10) Patent No.: US 8,607,388 B1
(45) Date of Patent: Dec. 17, 2013

(54) PATIENT-SUPPORT APPARATUS HAVING PATIENT ENTERTAINMENT PROJECTOR

(75) Inventors: Joseph P. Flanagan, Aurora, IN (US); Christopher D. Newport, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/545,747

(22) Filed: Jul. 10, 2012

(51) Int. Cl.
*A47C 31/00* (2006.01)
*A47B 7/02* (2006.01)
*A47D 7/00* (2006.01)

(52) U.S. Cl.
USPC ..... 5/658; 5/904; 5/905; 5/610; 5/425

(58) Field of Classification Search
USPC ..... 5/904, 905, 610, 658, 425; 345/156
See application file for complete search history.

(56) References Cited

U.S. PATENT DOCUMENTS

| | | | | |
|---|---|---|---|---|
| 2,534,083 | A | 12/1950 | Van Den Broek | |
| 4,287,620 | A * | 9/1981 | Zur | 5/615 |
| 4,607,401 | A * | 8/1986 | Sisson | 5/414 |
| 5,023,967 | A * | 6/1991 | Ferrand | 5/607 |
| 5,136,397 | A * | 8/1992 | Miyashita | 348/748 |
| 5,304,112 | A * | 4/1994 | Mrklas et al. | 600/27 |
| 5,542,138 | A * | 8/1996 | Williams et al. | 5/658 |
| 6,292,305 | B1 | 9/2001 | Sakuma et al. | |
| 6,486,792 | B1 * | 11/2002 | Moster et al. | 340/4.11 |
| 6,545,803 | B1 | 4/2003 | Sakuma et al. | |
| 6,656,137 | B1 * | 12/2003 | Tyldsley et al. | 601/15 |
| 6,727,489 | B2 * | 4/2004 | Yano | 250/221 |
| 7,418,747 | B1 * | 9/2008 | Myers | 5/308 |
| 7,591,034 | B2 * | 9/2009 | Kramer et al. | 5/425 |
| 7,769,430 | B2 | 8/2010 | Mostafavi | |
| 7,869,903 | B2 * | 1/2011 | Turner et al. | 700/275 |
| 7,882,580 | B2 * | 2/2011 | Hensley et al. | 5/186.1 |
| 7,905,306 | B2 | 3/2011 | Kramer et al. | |
| 7,988,849 | B2 * | 8/2011 | Biewer et al. | 210/94 |
| 8,151,387 | B2 * | 4/2012 | Osborne et al. | 5/618 |
| 8,307,481 | B2 * | 11/2012 | Katan | 5/710 |
| 2005/0165325 | A1 * | 7/2005 | Hornig | 600/549 |
| 2006/0162083 | A1 * | 7/2006 | Heimbrock | 5/662 |
| 2008/0016624 | A1 * | 1/2008 | Osborn | 5/658 |
| 2009/0064415 | A1 * | 3/2009 | Payne et al. | 5/620 |
| 2009/0121660 | A1 * | 5/2009 | Rawls-Meehan | 318/16 |
| 2009/0177327 | A1 * | 7/2009 | Turner et al. | 700/275 |
| 2010/0023094 | A1 | 1/2010 | Smith et al. | |
| 2011/0080335 | A1 | 4/2011 | Unger | |
| 2011/0083271 | A1 * | 4/2011 | Bhai | 5/610 |
| 2011/0138534 | A1 * | 6/2011 | Kozel | 5/600 |
| 2011/0167562 | A1 * | 7/2011 | Brown et al. | 5/610 |
| 2011/0247137 | A1 * | 10/2011 | Herman et al. | 5/600 |
| 2012/0123192 | A1 | 5/2012 | Somsundaram et al. | |

FOREIGN PATENT DOCUMENTS

| | | | | |
|---|---|---|---|---|
| JP | 63149971 | A * | 6/1988 | H04N 5/74 |

* cited by examiner

*Primary Examiner* — William Kelleher
*Assistant Examiner* — Eric Kurilla
(74) *Attorney, Agent, or Firm* — Barnes & Thornburg LLP

(57) ABSTRACT

A patient-support apparatus includes a deck, a headrail, and an entertainment system. The deck has a head end, a foot end spaced from the head end, a first side extending from the head end to the foot end, and a second side spaced from the first side and extending from the head end to the foot end. The headrail is coupled to the deck and extends along the first side of the deck near the head end of the deck. The entertainment system includes a user input and a projection device coupled to the headrail.

26 Claims, 6 Drawing Sheets

PATIENT-SUPPORT APPARATUS HAVING PATIENT ENTERTAINMENT PROJECTOR

BACKGROUND

This disclosure relates generally to a system for providing entertainment in a room. More particularly, but not exclusively, this disclosure relates to an entertainment system used with a patient-support apparatus such as a hospital bed, a stretcher, a wheel chair, or the like.

Sometimes, a patient supported on a patient-support apparatus would like to read or be entertained by a piece of media. When a patient is lying down or sitting up, a book or other piece of media is often held above the patient or out away from the patient. Holding books or other pieces of media may be difficult for a patient on a patient-support apparatus.

SUMMARY

A patient-support apparatus for use in a room with a ceiling and a wall is disclosed herein. The patient-support apparatus may include a base, a deck, and an entertainment system. The deck may be supported by the base and may include a head-deck section coupled to the base. The head-deck section may move between a substantially horizontal position and an inclined position. The entertainment system may include a user input and a projection device coupled to the head-deck section for movement therewith. The projection device may be oriented to project images on the ceiling of the room when the head-deck section is in the substantially horizontal position and to project images on the wall of the room when the head-deck section is in the inclined position.

In some embodiments, the patient-support apparatus may include a headrail coupled to the head-deck section for movement therewith. The headrail may extend along a side of the head-deck section between a head end and a foot end of the bed.

In some embodiments, the projection device may be coupled to the headrail. The projection device may include an image projector, a media input, and a controller coupled to the image projector and to the media input.

In some embodiments, the image projector may be configured to project images corresponding to e-books, video, photographs, artwork, and/or video games. The media input may be configured to receive a mobile phone, a media player, a music player, a camera, and/or a gaming device.

In some embodiments, the user input may be spaced apart from the projection device. The user input may be in communication with the projection device.

In some embodiments, the user input may be in communication with the projection device. The user input may be configured to receive voice commands from a user.

In some embodiments, the entertainment system may include an angle sensor configured to determine an incline angle of the head-deck section. The controller may be configured to receive the incline angle from the angle sensor and may be configured to adjust vertical keystoning of the image projector based at least in part on the incline angle.

In some embodiments, the headrail may be coupled to the head-deck section for movement relative to the head-deck section between a raised position and a lowered position. In the raised position, the head-deck section may extend up above a top surface of the head-deck section. In the lowered position, the head-deck section may be located below the top surface of the head-deck section.

In some embodiments, the entertainment system may include a headrail sensor configured to detect the headrail position in the raised position and in the lowered position. The controller may be configured to adjust zoom of the image projector at least in part based on the headrail position.

In some embodiments, the base may include a lower frame and an upper frame coupled to the lower frame for movement relative to the lower frame between a low position and a high position. In the low position, the upper frame may be spaced a first distance above the lower frame. In the high position, the upper frame may be spaced a second distance above the lower frame.

In some embodiments, the entertainment system includes an upper-frame sensor configured to determine an upper-frame position relative to the lower frame. The controller may be configured to adjust zoom of the image projector based at least in part on the upper-frame position.

In some embodiments, the entertainment system may include a foot-end-distance detector configured to determine a distance from the foot end of the base to the wall of the room. The controller may be configured to adjust zoom of the image projector based at least in part on the distance.

In some embodiments, the foot-end distance detector may be configured to determine a bed angle formed between the wall of the room and the longitudinal axis of the base. The controller may be configured to adjust horizontal keystoning of the image projector based at least in part on the bed angle.

According to another aspect of the present disclosure, a patient-support apparatus may include a deck, a headrail, and an entertainment system. The deck may have a head end, a foot end spaced from the head end, a first side extending from the head end to the foot end, and a second side spaced from the first side and extending from the head end to the foot end. The headrail may be coupled to the deck and may extend along the first side of the deck near the head end of the deck. The entertainment system may include a user input and a projection device coupled to the headrail.

In some embodiments, the deck may include a seat-deck section and a head-deck section. The head deck may be movable about a head-deck pivot axis from a substantially horizontal position to an inclined position. The headrail may be coupled to the head-deck section for movement therewith.

In some embodiments, the headrail may be coupled to the deck for movement relative to the deck between a raised position and a lowered position. In the raised position, the headrail may extend up above a top surface of the deck. In the lowered position, the headrail may be located below the top surface of the deck.

In some embodiments, the projection device may be configured to project images corresponding to e-books, video, photographs, artwork, and/or video games. The projection device may be configured to receive inputs from a mobile phone, a media player, a music player, a camera, and/or a gaming device.

In some embodiments, the patient-support apparatus may include a base. The base may include a lower frame and an upper frame. The upper frame may be coupled to the lower frame for movement between a low position, spaced a first distance above the lower frame, and a high position, spaced a second distance above the lower frame. The deck may be coupled to the upper frame for movement therewith.

Additional features, which alone or in combination with any other feature(s), such as those listed above, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which:

FIG. 2 is a side elevation view of the patient-support apparatus of FIG. 1 showing the head-deck section of the patient-support apparatus in the substantially horizontal position and showing that the entertainment system is projecting an image onto the ceiling of the room;

FIG. 3 is a view similar to FIG. 2 showing the head-deck section moved to a slightly-inclined position forming an angle with a base supporting the deck and showing that the entertainment system is projecting an image onto the ceiling of the room;

FIG. 4 is a view similar to FIGS. 2 and 3 showing the head-deck section moved to a further inclined position forming an angle with the base and showing that the entertainment system is still projecting an image onto the wall of the room;

FIG. 5 is a view similar to FIGS. 2-4 showing the head-deck section moved to a fully inclined position forming an angle with the base and showing that the entertainment system is projecting an image onto the wall of the room;

DETAILED DESCRIPTION

Figure 2:
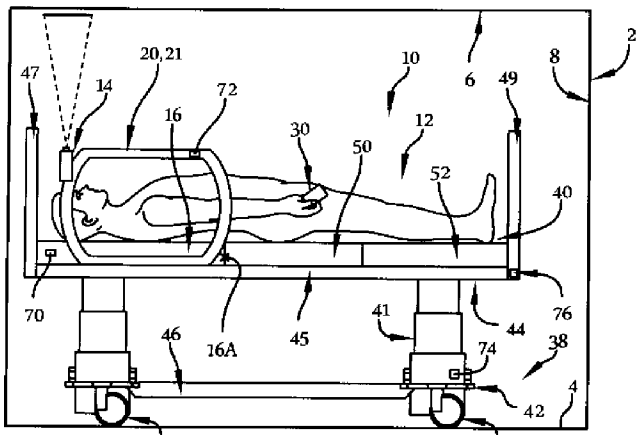
Figure 5:
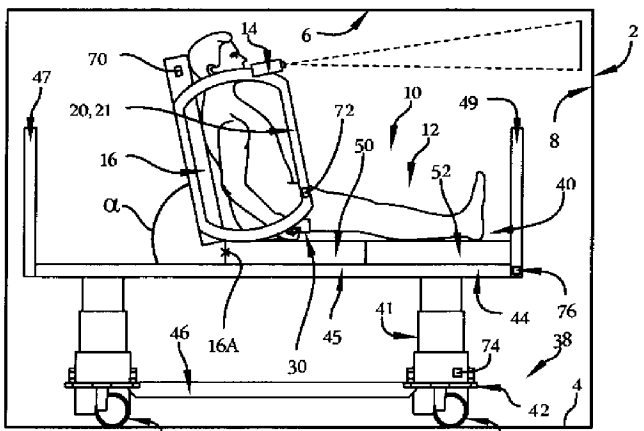
Figure 4:
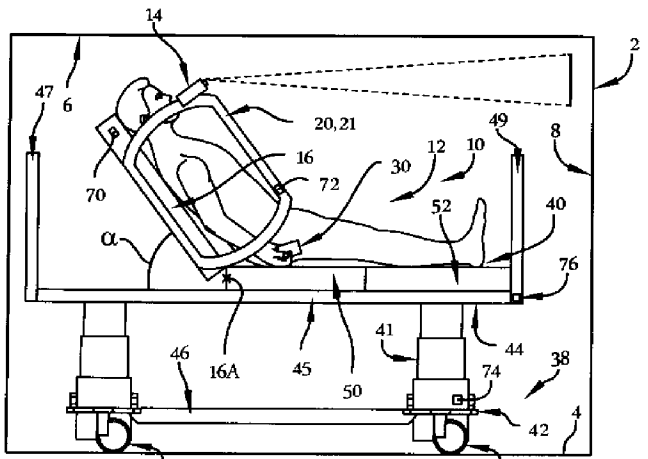

According to this disclosure a patient-support apparatus is embodied as a hospital bed 10 for use in a room 2 with a floor 4, a ceiling 6, and a wall 8 as shown in FIGS. 2-5. The bed 10 includes a person support 12 and an entertainment system 14. The person support 12 includes a head-deck section 16 that is movable from a substantially horizontal position, as shown in FIG. 2, to an inclined position, as shown in FIG. 5. The entertainment system 14 provides means for projecting an image on the ceiling 6 of the room 2 when the head-deck section 16 is in the substantially horizontal position and for projecting an image on the wall 8 of the room 2 when the head-deck section 16 is in the inclined position.

Figure 1:
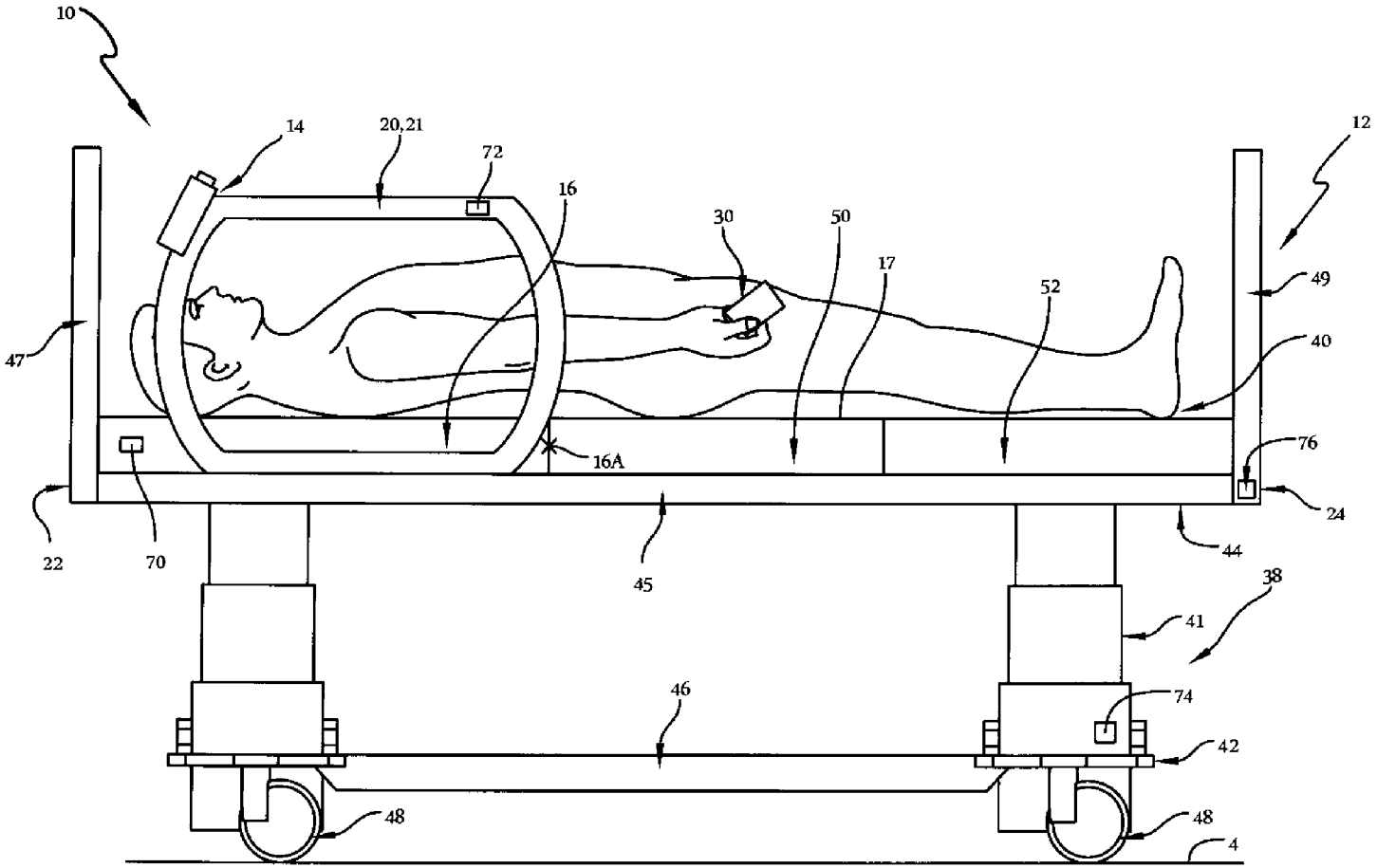
FIG. 1 is a side elevation view of a patient-support apparatus embodied as a hospital bed including a headrail and an entertainment system coupled to the headrail.
Figure 9:
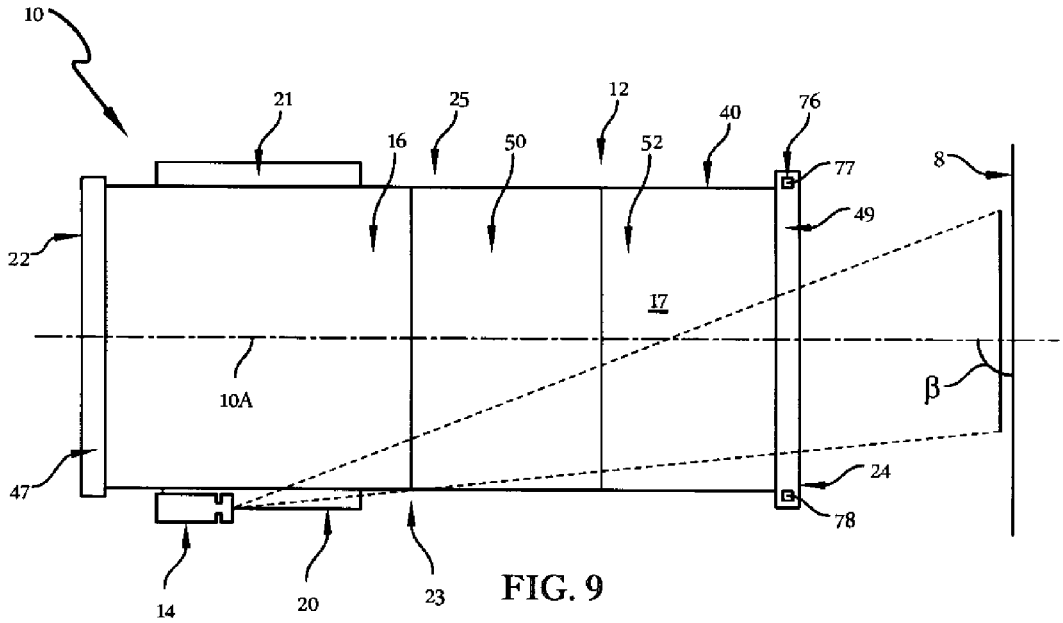
FIG. 9 is top plan view of the patient support apparatus of FIG. 1 showing the patient-support apparatus positioned parallel to the wall and projecting an image on the wall with a first amount of horizontal keystoning.
Figure 10:
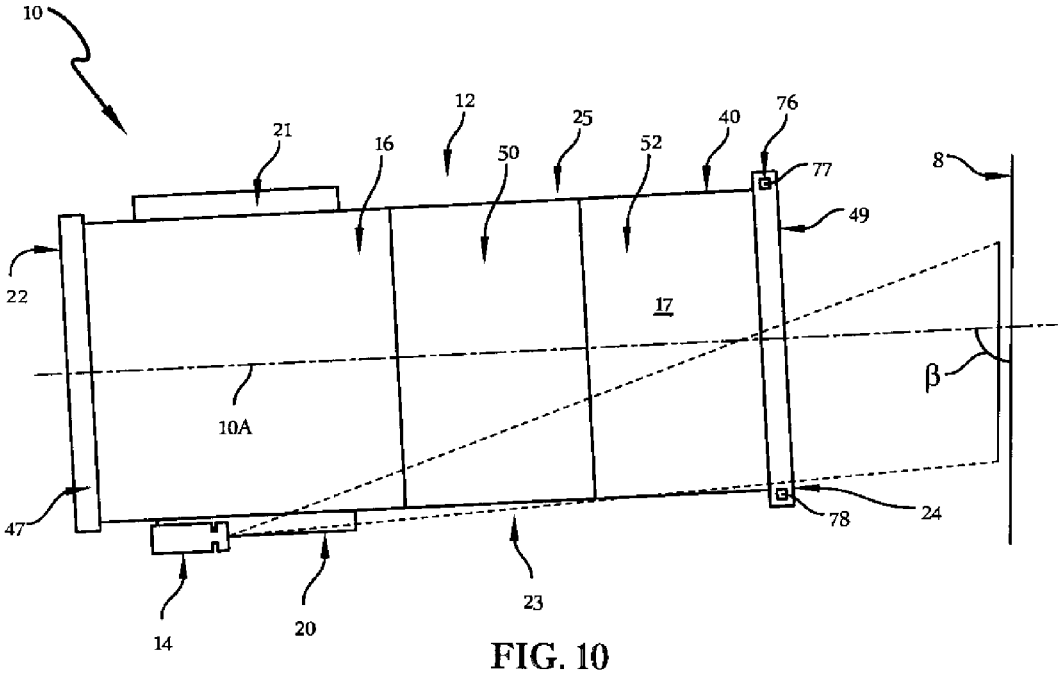
FIG. 10 is a top plan view of the patient support of FIG. 9 showing the patient-support apparatus angled relative to the wall and projecting an image on the wall with a second amount of horizontal keystoning.

The person support 12 further includes a headrail 20 and the entertainment system 14 is coupled to the headrail 20 as shown in FIG. 1. The headrail 20 is coupled to the head-deck section 16 for movement with the head-deck section 16 from the substantially horizontal position to the inclined position as shown in FIGS. 2-5. The headrail 20 extends along a side of the head-deck section 16 between a head end 22 and a foot end 24 of the bed 10 as shown in FIGS. 9 and 10.

Figure 6:
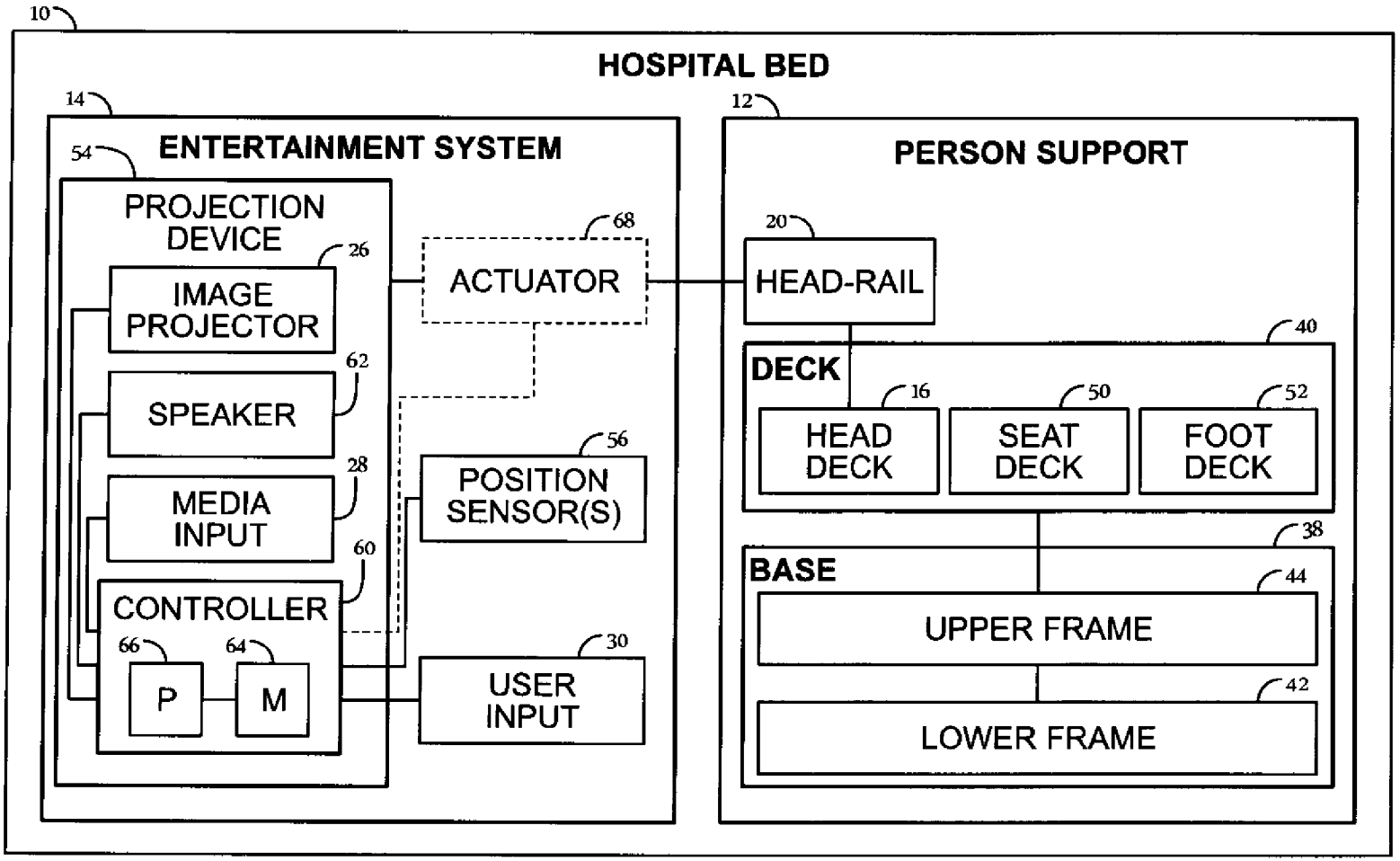
FIG. 6 is a block diagram of the patient-support apparatus showing that the entertainment system includes a projection device, a number of position sensors coupled to the projection device, and a user input coupled to the projection device.
Figure 11:
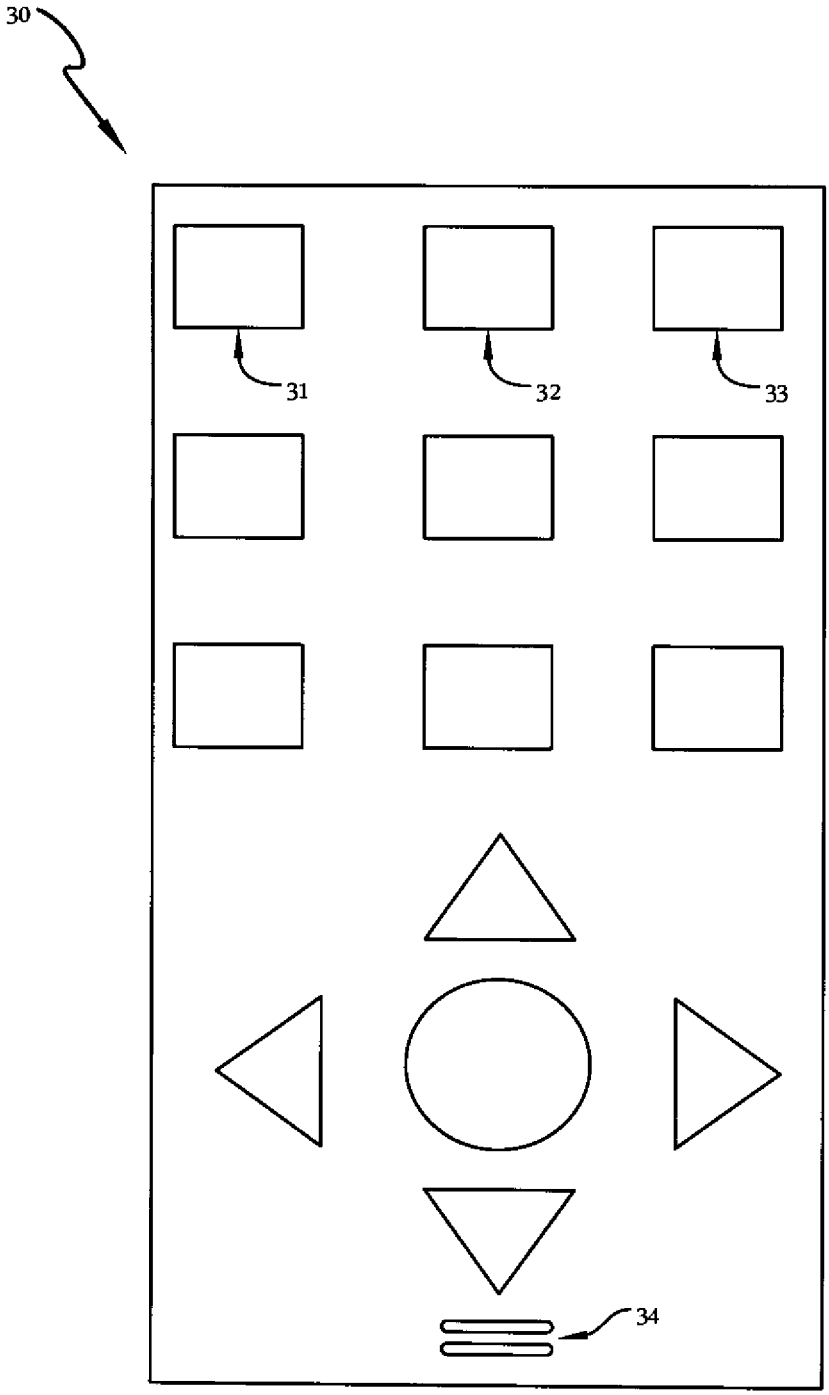
FIG. 11 is a top plan view of an exemplary user input embodied as a remote control with buttons and a microphone for receiving voice commands.

The entertainment system 14 includes an image projector 26, a media input 28, and a user input 30 as shown in FIG. 6. The image projector 26 is configured to project images corresponding to e-books, video, photographs, artwork, video games, and other media. The media input 28 is configured to receive inputs from mobile phones, media players, music players, cameras, gaming devices, television tuners, and other sources. The user input 30 is illustratively a remote control including buttons 31, 32, 33 and a microphone 34 as shown in FIG. 11.

In the illustrative embodiment, the person support 12 includes a base 38, a deck 40, and pair of headrails 20, 21 as shown in FIG. 1. The base 38 is supported on the floor 4 of the room 2. The deck 40 is coupled to the base 38 for movement relative to the base 38 and is supported above the floor 4. The headrails 20, 21 are coupled to the deck 40 and are movable with the deck 40.

The base 38 includes a lower frame 42 and an upper frame 44 as shown in FIG. 1. The lower frame 42 includes a rail 46 and a number of casters 48 configured to roll along the floor 4. The upper frame 44 includes a rail 45, a headboard 47 extending along the head end 22 of the bed 10, and a footboard 49 extending along the foot end 24 of the bed 10 as shown in FIG. 1. The upper frame 44 is coupled to the lower frame 42 by a lift system 41 for movement between a low position and a high position. In the low position, the upper frame 44 is spaced a first distance above the lower frame 42. In the high position, the upper frame 44 is spaced a second distance (greater than the first distance) above the lower frame 42.

The deck 40 includes the head-deck section 16, a seat-deck section 50, and a foot-deck section 52 as shown in FIG. 1. The head-deck section 16 is located at the head end 22 of the bed 10 and is movable about a pivot axis 16A from the substantially horizontal position, shown in FIG. 2, to the inclined position shown in FIG. 5. The head-deck section 16 forms an incline angle $\alpha$ with upper frame 44. The seat-deck section 50 is located between the head-deck section 16 and the foot-deck section 52. The foot-deck section 52 is located at the foot end 24 of the bed 10.

Figure 3:
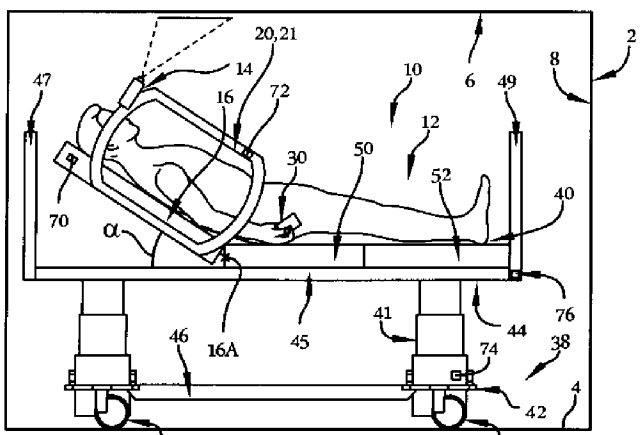
FIGS. 2-5 are a series of side elevation views of the bed of FIG. 1 showing that the headrail and entertainment system are coupled to a head-deck section that moves from a substantially horizontal position to an inclined position, and showing that the entertainment system is configured to project an image onto a ceiling or a wall of a room depending on the position of the head deck section.

Illustratively, the entertainment system 14 projects an image on the ceiling 6 of the room 2 while the incline angle is between about 0 degrees and about 45 degrees as suggested by FIGS. 2 and 3. Illustratively, the entertainment system 14 projects an image on the wall 8 of the room 2 while the incline angle is between about 45 degrees and about 90 degrees as suggested by FIGS. 4 and 5. In other embodiments, other angle ranges may be used to determine if the entertainment system 14 projects on to the ceiling 6 or the wall 8. In some embodiments, entertainment system 14 may be disabled when the incline angle $\alpha$ is in an undesirable range.

Figure 7:
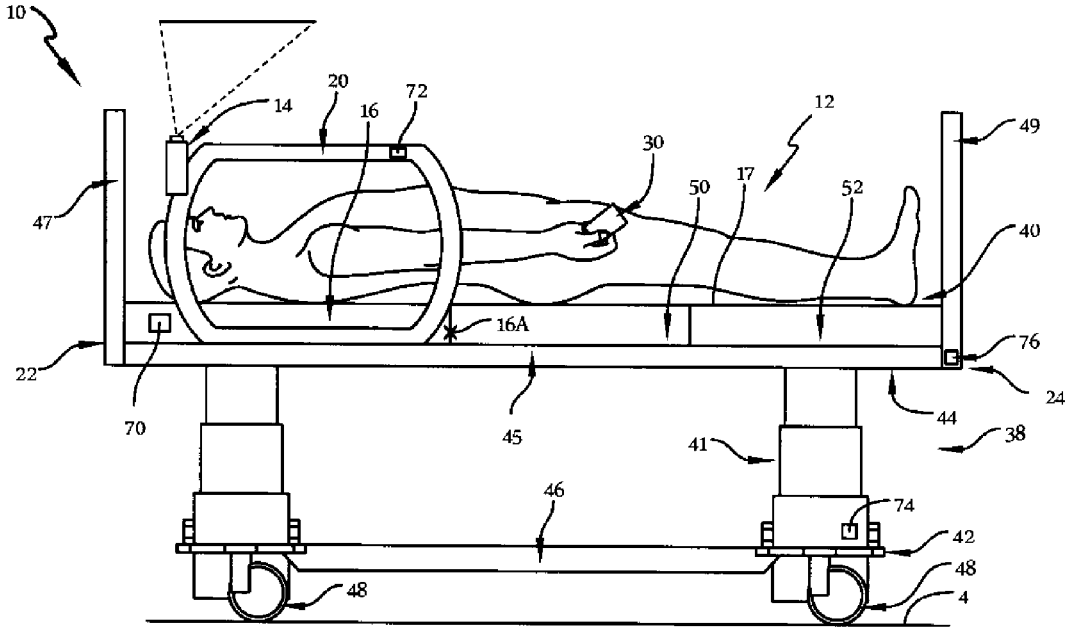
FIG. 7 is a side elevation view of the patient-support apparatus of FIG. 1 showing that the projection device projects an image at a first amount of zoom when the headrail is in a raised position.
Figure 8:
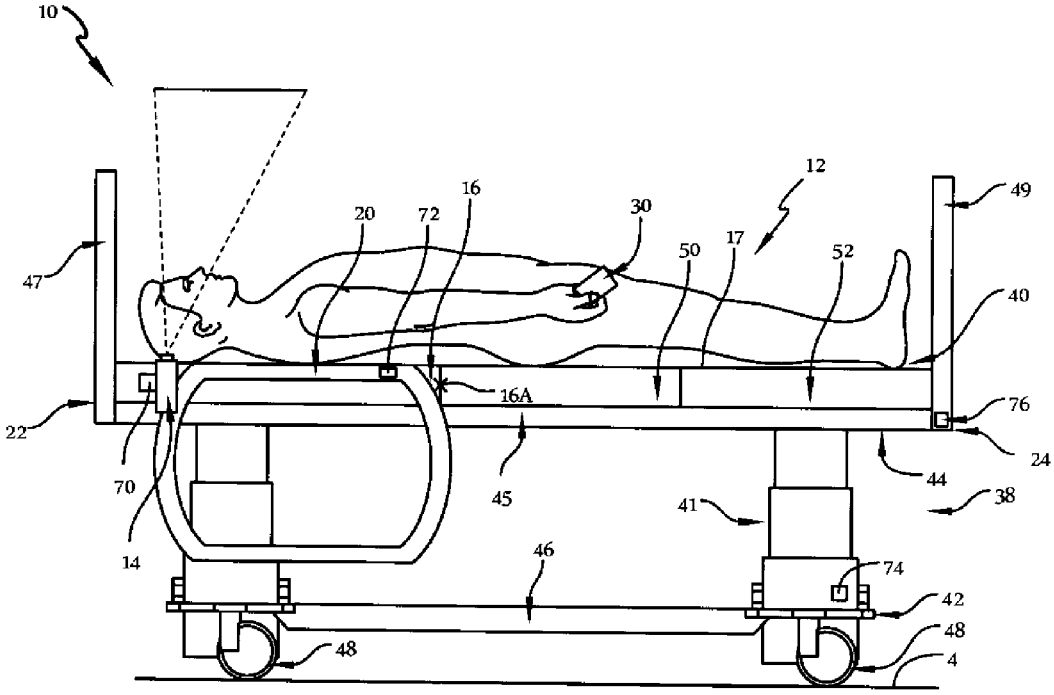
FIG. 8 is a view similar to FIG. 7 showing that the projection device projects an image at a second amount of zoom when the headrail is in a lowered position.

The headrails 20, 21 extend along a first side 23 and a second side 25 of the bed 10 between the head end 22 and the foot end 24 of the bed 10 as shown, for example, in FIGS. 9 and 10. The headrails 20, 21 move between a raised position and a lowered position as suggested by FIGS. 7 and 8. In the raised position, the headrails 20, 21 extend up above a top surface 17 of the head-deck section 16 as shown in FIG. 7. In the lowered position, the headrails 20 are located below the top surface 17 of the head-deck section 16 as shown in FIG. 8.

The entertainment system 14 includes a projection device 54, a user input 30, and a number of position sensors 56 as shown in FIG. 6. The projection device 54 is coupled to the headrail 20 for movement with the headrail 20 and the head-deck section 16. The user input 30 is in communication with the projection device 54 and provides inputs for the projection device 54. The position sensors 56 are also in communication with the projection device 54 and provide inputs for the projection device 54.

The projection device 54 of the illustrative embodiment includes a controller 60, the image projector 26 coupled to the controller 60, the media input 28 coupled to the controller 60, and a speaker 62 coupled to the controller 60. The controller 60 is configured to receive inputs from the user input 30 and the position sensors 56, to receive data from the media input 28, and to control the image projector 26 and the speaker 62. The image projector 26 is configured to produce an image and to adjust horizontal keystoning, vertical keystoning, and zoom of the image. The media input 28 is illustratively embodied as a USB port but in other embodiments may be an Ethernet port, a FireWire port, a wireless receiver, or another suitable input port. In the illustrative embodiment, the projection device 54 is similar to the PK100 DLP Pico Pocket Projector with LED illumination available from Optoma USA. In other embodiments, projection device 54 may be of another suitable type.

The controller 60 illustratively includes a memory 64 and a processor 66 coupled to the memory 64 as shown in FIG. 6. The memory 64 may be embodied as, or otherwise include, one or more memory devices or data storage locations including, for example, dynamic random access memory devices (DRAM), synchronous dynamic random access memory devices (SDRAM), double-data rate synchronous dynamic random access memory device (DDR SDRAM), mask read-only memory (ROM) devices, erasable programmable ROM (EPROM), electrically erasable programmable ROM (EEPROM) devices, flash memory devices, and/or other volatile and/or non-volatile memory devices. The processor 66 may be embodied as any type of processor capable of executing the instructions stored in the memory 64. The illustrative processor 66 is a single core processor, but processors having multiple cores may be used in other embodiments.

In some embodiments, the entertainment system 14 may include an actuator 68 as suggested in FIG. 6. In such embodiments, the actuator 68 is coupled to the controller 60 and is coupled between the headrail 20 and the projection device 54. The actuator 68 is configured to change the horizontal and/or vertical mounting angle of the projection device 54 relative to the headrail 20. By changing the mounting angle of the projection device 54, the actuator 68 physically alters the horizontal and vertical keystoning of the image projector 26.

The number of position sensors 56 includes an angle sensor 70, a headrail sensor 72, an upper-frame sensor 74, and a foot-end-distance detector 76 as shown in FIG. 1. The angle sensor 70 is illustratively a potentiometer coupled to the head-deck section 16. The headrail sensor 72 is illustratively a pressure switch coupled to the headrail 20 and is coupled to the headrail 20. The upper-frame sensor 74 is illustratively a potentiometer coupled to the base 38. The foot-end-distance detector 76 is coupled to the upper frame 44 and illustratively includes a first laser distance detector 77 and a second laser distance detector 78, spaced horizontally apart from the first laser distance detector 77 as shown in FIGS. 9 and 10.

The angle sensor 70 is configured to detect the incline angle $\alpha$ of the head-deck section 16 relative to the seat-deck section 50 as suggested in FIGS. 2-5. In operation, the controller 60 is configured to receive the incline angle $\alpha$ from the angle sensor and to adjust vertical keystoning of the image projector based at least in part on the incline angle $\alpha$.

The headrail sensor 72 is configured to detect the position of the headrail 20 as suggested in FIGS. 7 and 8. In operation, the controller 60 is configured to adjust zoom of the image projector 26 at least in part based on the headrail position detected by the headrail sensor 72.

The upper-frame sensor 74 configured to detect the position of the upper frame 44 as suggested in FIG. 1. In operation, the controller 60 is configured to adjust zoom of the image projector 26 based at least in part on the position of the upper frame 44 detected by the upper-frame sensor 74.

The foot-end-distance detector 76 is configured to detect distance of the bed 10 from the wall 8 and to determine an angle $\beta$ formed by a longitudinal axis 10A of the bed 10 and the wall 8 as suggested in FIGS. 9 and 10. In operation, the controller 60 is configured to adjust zoom of the image projector 26 based at least in part on the distance of the bed 10 from the wall 8. Additionally, in the illustrative embodiment, the controller 60 is configured to adjust horizontal keystoning of the image projector 26 based at least in part on the bed angle $\beta$.

User input 30 is illustratively a wireless remote control configured to select images to be displayed, to change input sources projected by the projection device 54, and to change the volume of the speaker 62. User input 30 may also be coupled to a nurse call system (not shown) so that a nurse call is transmitted from the user input to the nurse call system. In other embodiments, user input 30 may be or may include a keyboard, a wired control, a joystick, or any other suitable input device.

Although certain embodiments have been described in detail above, variations and modifications exist within the scope and spirit of this disclosure as described and as defined in the following claims.

The invention claimed is:

1. A patient-support apparatus for use in a room with a ceiling and a wall, the patient-support apparatus comprising a base, a deck supported by the base, the deck including a head-deck section coupled to the base to move between a substantially horizontal position and an inclined position, and an entertainment system including a user input and a projection device coupled to the head-deck section for movement therewith between the substantially horizontal position and the inclined position and oriented to project images on the ceiling of the room when the head-deck section is in the substantially horizontal position and to project images on the wall of the room when the head-deck section is in the inclined position, the projection device configured to adjust at least one of zoom, vertical keystoning, and horizontal keystoning of an image projected on the ceiling or the wall in order to provide a legible image on the ceiling or the wall in response to movement of the base or the deck.

2. The patient-support apparatus of claim 1, further comprising a headrail coupled to the head-deck section for movement therewith between the substantially horizontal position and the inclined position and extending along a side of the head-deck section between a head end and a foot end of the patient-support apparatus.

3. The patient-support apparatus of claim 2, wherein the projection device is coupled to the headrail.

4. The patient-support apparatus of claim 3, wherein the projection device includes an image projector, a media input, and a controller coupled to the image projector and to the media input.

5. The patient-support apparatus of claim 4, wherein the image projector is configured to project images corresponding to at least one of e-books, video, photographs, artwork, and video games.

6. The patient-support apparatus of claim 4, wherein the media input is configured to receive inputs from at least one of a mobile phone, a media player, a music player, a camera, and a gaming device.

7. The patient-support apparatus of claim 4, wherein the headrail is coupled to the head-deck section for movement upwardly and downwardly relative to the head-deck section.

8. The patient-support apparatus of claim 7, wherein the entertainment system includes a headrail sensor configured to detect a position of the headrail relative to the head-deck section, and the controller is configured to adjust zoom of the image projector at least in part based on the detected position of the headrail.

9. The patient-support apparatus of claim 1, wherein the user input is spaced apart from and is in communication with the projection device.

10. The patient-support apparatus of claim 1, wherein the user input is in communication with the projection device and is configured to receive voice commands from a user.

11. The patient-support apparatus of claim 1, wherein the projection device includes an image projector and a controller coupled to the image projector, the entertainment system includes an angle sensor configured to detect an incline angle of the head-deck section, and the controller is configured to receive the incline angle from the angle sensor and to adjust vertical keystoning of the image projector based at least in part on the incline angle.

12. The patient-support apparatus of claim 1, wherein the base includes a lower frame and an upper frame coupled to the lower frame for movement upwardly and downwardly relative to the lower frame.

13. The patient-support apparatus of claim 12, wherein the projection device includes an image projector and a controller coupled to the image projector, the entertainment system includes an upper-frame sensor configured to detect an upper-frame position relative to the lower frame, and the controller is configured to adjust zoom of the image projector based at least in part on the upper-frame position.

14. The patient-support apparatus of claim 1, wherein the projection device includes an image projector and a controller coupled to the image projector, the entertainment system includes a foot-end-distance detector configured to detect a distance from the foot end of the base to the wall of the room, and the controller is configured to adjust zoom of the image projector based at least in part on the distance.

15. The patient-support apparatus of claim 1, wherein the projection device includes an image projector and a controller coupled to the image projector, the entertainment system includes a foot-end-distance detector configured to detect a bed angle formed between the wall of the room and the longitudinal axis of the base, and the controller is configured to adjust horizontal keystoning of the image projector based at least in part on the bed angle.

16. The patient-support apparatus of claim 1, wherein the entertainment system includes a sensor coupled to the projection device and the projection device is configured to adjust at least one of zoom, vertical keystoning, and horizontal keystoning of the image based at least in part on information from the sensor.

17. A patient-support apparatus comprising a deck having a head end, a foot end spaced from the head end, a first side extending from the head end to the foot end, and a second side spaced from the first side and extending from the head end to the foot end, a headrail coupled to the deck and extending along the first side of the deck near the head end of the deck, and an entertainment system including a user input and a projection device coupled to the headrail, the projection device configured to adjust at least one of zoom, vertical keystoning, and horizontal keystoning of an image projected on a surface spaced apart from the projection device in order to provide a legible image on the surface in response to movement of the deck or the headrail.

18. The patient-support apparatus of claim 17, wherein the deck includes a seat-deck section and a head-deck section movable about a head-deck pivot axis from a substantially horizontal position to an inclined position.

19. The patient-support apparatus of claim 18, wherein the headrail is coupled to the head-deck section for movement therewith.

20. The patient-support apparatus of claim 17, wherein the projection device is configured to project images corresponding to at least one of e-books, video, photographs, artwork, and video games.

21. The patient-support apparatus of claim 17, wherein the projection device is configured to receive inputs from at least one of a mobile phone, a media player, a music player, a camera, and a gaming device.

22. The patient-support apparatus of claim 17, wherein the entertainment system includes a sensor coupled to the projection device and the projection device is configured to adjust at least one of zoom, vertical keystoning, and horizontal keystoning of the image based at least in part on information from the sensor.

23. A patient-support apparatus for use in a room with a ceiling and a wall, the patient-support apparatus comprising a base, a deck supported by the base, the deck including a head-deck section coupled to the base to move between a substantially horizontal position and an inclined position, an entertainment system including a user input and a projection device coupled to the head-deck section for movement therewith and oriented to project images on the ceiling of the room when the head-deck section is in the substantially horizontal position and to project images on the wall of the room when the head-deck section is in the inclined position, and a headrail coupled to the head-deck section for movement therewith and extending along a side of the head-deck section between a head end and a foot end of the patient-support apparatus, wherein the projection device is coupled to the headrail, the projection device includes an image projector, a media input, and a controller coupled to the image projector and to the media input, the entertainment system includes an angle sensor configured to determine an incline angle of the head-deck section, and the controller is configured to receive the incline angle from the angle sensor and to adjust vertical keystoning of the image projector based at least in part on the incline angle.

24. A patient-support apparatus for use in a room with a ceiling and a wall, the patient-support apparatus comprising a base, a deck supported by the base, the deck including a head-deck section coupled to the base to move between a substantially horizontal position and an inclined position, an entertainment system including a user input and a projection device coupled to the head-deck section for movement therewith and oriented to project images on the ceiling of the room when the head-deck section is in the substantially horizontal position and to project images on the wall of the room when the head-deck section is in the inclined position, and a headrail coupled to the head-deck section for movement therewith and extending along a side of the head-deck section between a head end and a foot end of the patient-support apparatus, wherein the projection device is coupled to the headrail, the projection device includes an image projector, a media input, and a controller coupled to the image projector and to the media input, the headrail is coupled to the head-deck section for movement relative to the head-deck section between a raised position, extending up above a top surface of the head-deck section, and a lowered position, located below the top surface of the head-deck section, and the entertainment system includes a headrail sensor configured to detect the headrail position in the raised position and in the lowered position, and the controller is configured to adjust zoom of the image projector at least in part based on the headrail position.

25. A patient-support apparatus for use in a room with a ceiling and a wall, the patient-support apparatus comprising a base, a deck supported by the base, the deck including a head-deck section coupled to the base to move between a substantially horizontal position and an inclined position, an entertainment system including a user input and a projection device coupled to the head-deck section for movement therewith and oriented to project images on the ceiling of the room when the head-deck section is in the substantially horizontal position and to project images on the wall of the room when the head-deck section is in the inclined position, and a headrail coupled to the head-deck section for movement therewith and extending along a side of the head-deck section between a head end and a foot end of the patient-support apparatus, wherein the projection device is coupled to the headrail, the projection device includes an image projector, a media input, and a controller coupled to the image projector and to the media input, the base includes a lower frame and an upper frame coupled to the lower frame for movement relative to the lower frame between a low position, spaced a first distance above the lower frame, and a high position, spaced a second distance above the lower frame, and the entertainment system includes an upper-frame sensor configured to determine an upper-frame position relative to the lower frame, and the controller is configured to adjust zoom of the image projector based at least in part on the upper-frame position.

26. A patient-support apparatus for use in a room with a ceiling and a wall, the patient-support apparatus comprising a base, a deck supported by the base, the deck including a head-deck section coupled to the base to move between a substantially horizontal position and an inclined position, an entertainment system including a user input and a projection device coupled to the head-deck section for movement therewith and oriented to project images on the ceiling of the room when the head-deck section is in the substantially horizontal position and to project images on the wall of the room when the head-deck section is in the inclined position, and a headrail coupled to the head-deck section for movement therewith and extending along a side of the head-deck section between a head end and a foot end of the patient-support apparatus, wherein the projection device is coupled to the headrail, the projection device includes an image projector, a media input, and a controller coupled to the image projector and to the media input, and the entertainment system includes a foot-end-distance detector configured to determine a distance from the foot end of the base to the wall of the room, and the controller is configured to adjust zoom of the image projector based at least in part on the distance.

* * * * *